US008615189B2

(12) United States Patent
Imamiya et al.

(10) Patent No.: US 8,615,189 B2
(45) Date of Patent: Dec. 24, 2013

(54) IMAGE FORMING APPARATUS AND IMAGE FORMING METHOD

(75) Inventors: Koji Imamiya, Kanagawa-ken (JP); Takayasu Aoki, Shizuoka-ken (JP); Tsuyoshi Itou, Shizuoka-ken (JP); Hiromichi Mitamura, Shizuoka-ken (JP); Noboru Furuyama, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 275 days.

(21) Appl. No.: 13/050,068

(22) Filed: Mar. 17, 2011

(65) Prior Publication Data

US 2011/0262197 A1 Oct. 27, 2011

Related U.S. Application Data

(60) Provisional application No. 61/327,863, filed on Apr. 26, 2010.

(51) Int. Cl.
*G03G 15/20* (2006.01)

(52) U.S. Cl.
USPC ..... 399/341

(58) Field of Classification Search
USPC ..... 399/341
See application file for complete search history.

(56) References Cited

U.S. PATENT DOCUMENTS

| | | | | |
|---|---|---|---|---|
| 2004/0080787 | A1* | 4/2004 | Kakikawa et al. | 399/341 |
| 2006/0111237 | A1* | 5/2006 | Takayama et al. | 503/221 |
| 2009/0154970 | A1* | 6/2009 | Yoshida et al. | 399/341 |
| 2010/0196063 | A1 | 8/2010 | Iguchi et al. | |

FOREIGN PATENT DOCUMENTS

| | | |
|---|---|---|
| CN | 1773382 | 5/2006 |
| JP | 06-258980 | 9/1994 |
| JP | 06-270431 | 9/1994 |
| JP | 07-049634 | 2/1995 |
| JP | 07-245668 | 9/1995 |
| JP | 2004-61820 | 2/2004 |
| JP | 2005205625 | 8/2005 |

OTHER PUBLICATIONS

Korean Office Action for Korean Application No. 10-2011-0025267 mailed on Jun. 14, 2012.
Japanese Office Action (and translation) mailed Apr. 16, 2013 for Japanese Application Serial No. 2011-073304, 8 pages.
Chinese Office Action for Chinese Patent Application No. 201110060092.9 mailed on May 6, 2013.

* cited by examiner

*Primary Examiner* — Ryan Walsh
(74) *Attorney, Agent, or Firm* — Turocy & Watson, LLP

(57) ABSTRACT

According to one embodiment, an image forming apparatus includes a mode setting section configured to set an operation mode in a manner that the image forming apparatus is operated in an erasing mode if an erasing operation is instructed, a supplying section configured to supply a medium on which the image formation is completed, and which is set in an designated or specified receiving section, a decoloring section configured to decolor the color of the formed image by carrying the medium to a heating section that includes at least heating and decoloring function, and a return section configured to return the operation mode to a predetermined mode except for the erasing mode from the erasing mode, when the last medium on which the image formation is completed and which is set in the receiving section is decolored.

20 Claims, 7 Drawing Sheets

IMAGE FORMING APPARATUS AND IMAGE FORMING METHOD

CROSS-REFERENCE TO RELATED APPLICATIONS

This application is based upon and claims the benefit of U.S. Provisional Application No. 61/327,863, filed on Apr. 26, 2010; the entire contents of which are incorporated herein by reference.

FIELD

Embodiments described herein relate generally to an image forming apparatus and an image forming method.

BACKGROUND

Conventionally, an image forming apparatus that performs image formation using a color erasable toner and an image erasing apparatus that can change the image to a decoloring state from a color forming state are known. In the color erasable toner, a binding of a color pigment and a color former is cut by heating, and the decoloring is performed. In the conventional image erasing apparatus, for example, the paper is required to be heated at 120 to 150° C. over about two hours so as to erase the color of the toner image.

As described above, since it requires about two hours for heating and about one hour for cooling, the image forming apparatus and the image erasing apparatus have each been separately provided until now.

DETAILED DESCRIPTION

In general, according to one embodiment, a mode setting section configured to set an operation mode in a manner that the image forming apparatus is operated in an erasing mode if an erasing operation is instructed, a supplying section configured to supply a medium on which the image formation is completed, and which is set in an designated or specified receiving section, a decoloring section configured to decolor the color of the formed image by carrying the medium to a heating section that includes at least heating and decoloring function, and a return section configured to return the operation mode to a predetermined mode except for the erasing mode from the erasing mode, when the last medium on which the image formation is completed and which is set in the receiving section is decolored.

Hereinafter, the embodiments of the invention are described.

First Embodiment

Figure 1:
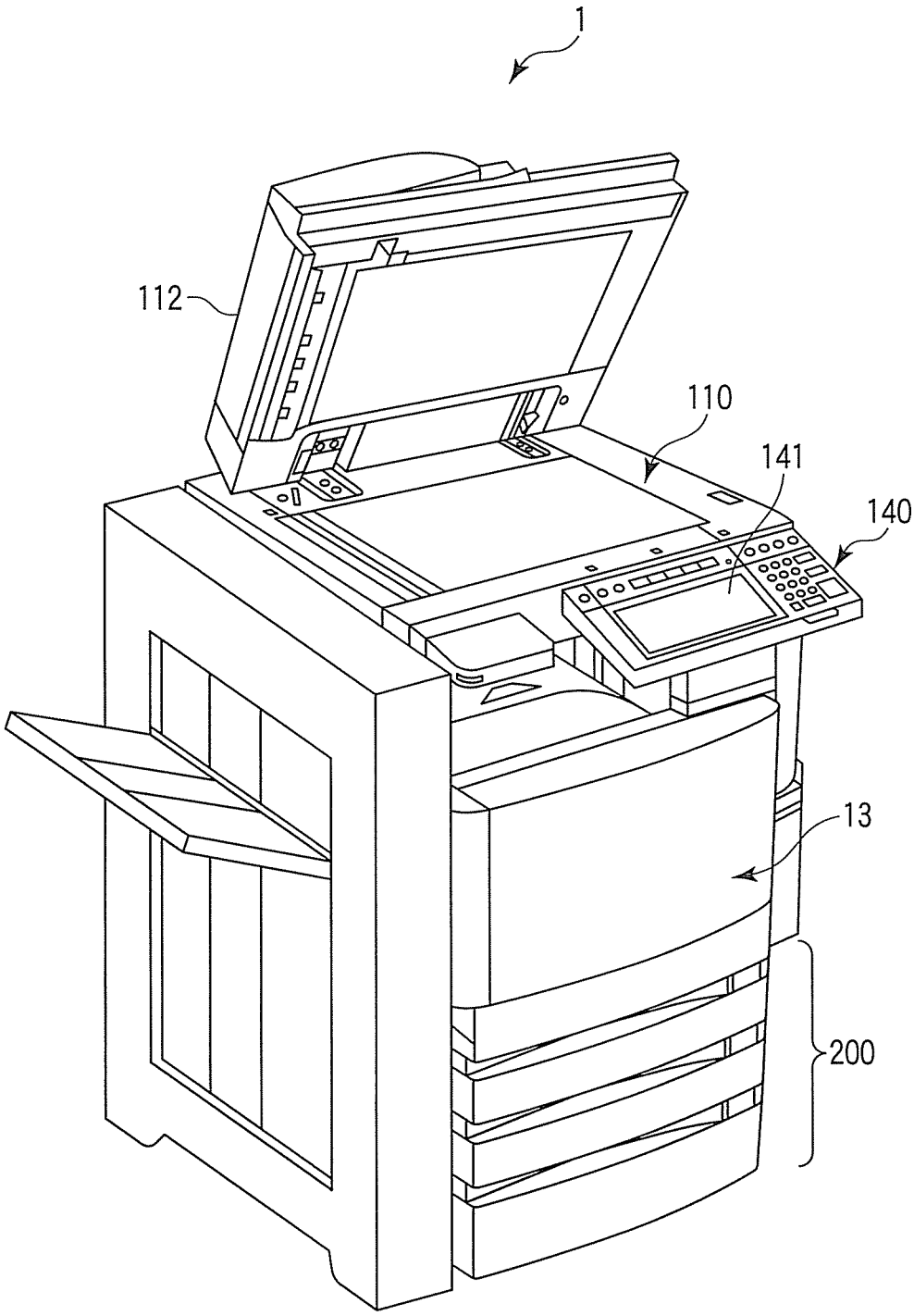
FIG. 1 is an exemplary perspective view schematically illustrating a shape of the image forming apparatus of an embodiment.

FIG. 1 is an exemplary perspective view illustrating a schematic shape of an image forming apparatus of an embodiment according to the invention.

An image forming apparatus 1 has a print section 130, a paper tray 200, a scan section 110, an auto feed section 112 and a control panel 140.

The print section 130 outputs an image information as an output image for example, called a hard copy or a printout. The paper tray 200 supplies an output medium that is a paper of any size used in the image output with respect to the print section 130. The scan section 110 fetches the image information from the documents as an image data. The auto feed section 112 carries the document of which the reading is finished to a discharging position from the reading position and guides the following document to the reading position. The control panel 140 is an instruction input section that instructs the operation of the image forming apparatus 1 such as the start of image formation in the print section 130 or the start of reading the image information of the document by the scan section 110. The control panel 140 has a display section 141 for inputting the instruction and displaying the information with respect to the operator.

Figure 2:
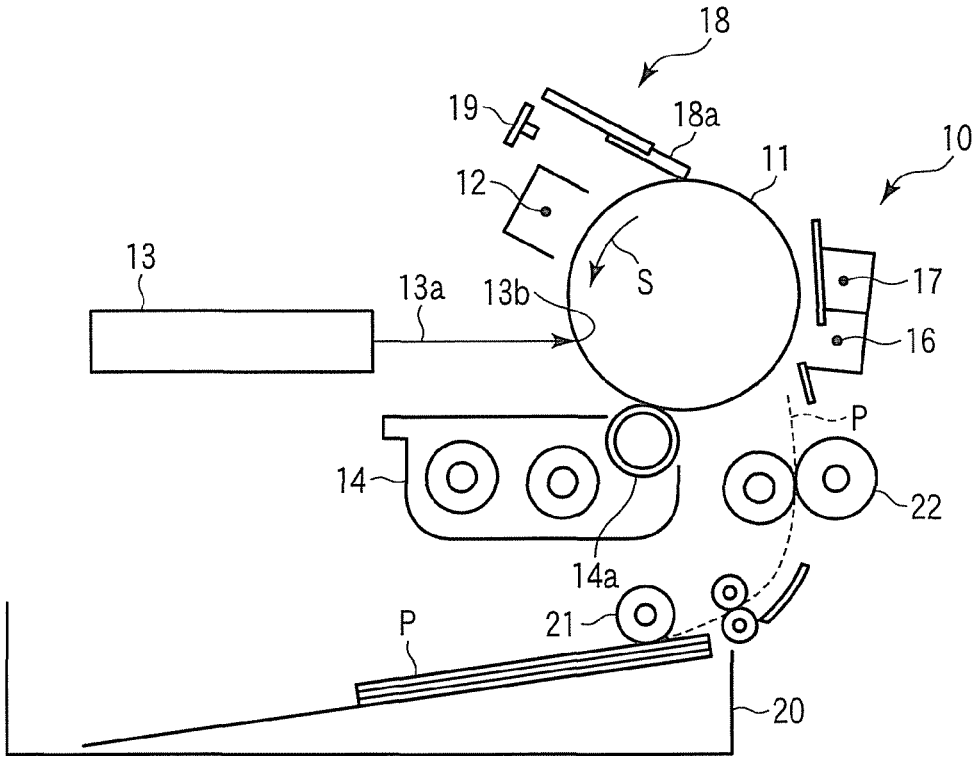
FIG. 2 is an exemplary constitution view illustrating an image forming section of the image forming apparatus of the embodiment.
Figure 3:
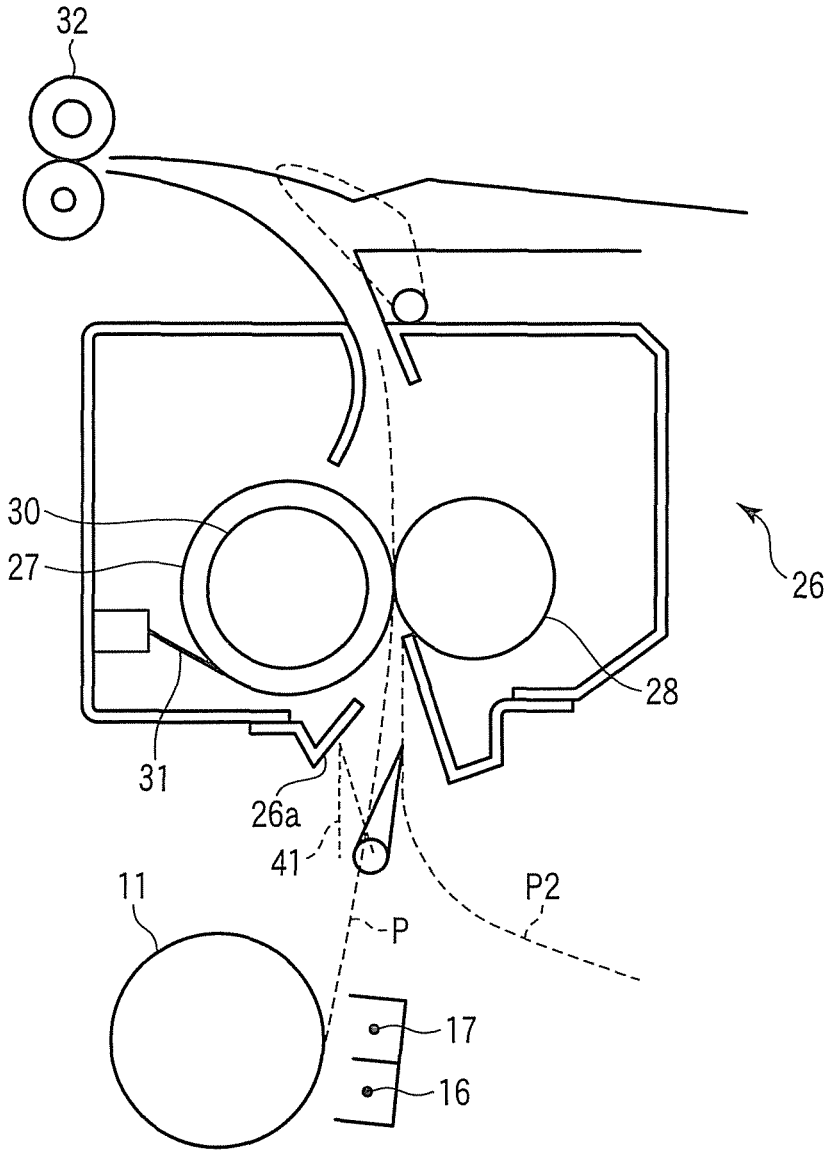
FIG. 3 is an exemplary constitution view illustrating a fixing device of the image forming apparatus of the embodiment.

FIG. 2 is an exemplary constitution view illustrating an image forming section 10 of the image forming apparatus of the embodiment. FIG. 3 is an exemplary constitution view illustrating a fixing device of the image forming apparatus of the embodiment. The image forming apparatus 1 of the embodiment performs the image formation using a toner in which the color is erased by heating. The image forming apparatus 1 has an erasing function of a toner image.

A photoconductive drum 11 of the image forming section 10 includes an Organic Photo Conductor (OPC) at the surface of a support member of ϕ60 mm. The photoconductive drum 11 is driven in the direction of the arrow s with a peripheral velocity of 215 mm/sec of a first paper carrying velocity. A charging charger 12, a laser exposure device 13, a developing device 14, a transfer charger 16, a peeling charger 17, a cleaner 18 having a cleaning blade 18*a* and a charge neutralization LED 19 are arranged at the periphery of the photoconductive drum 11.

The charging charger 12 charges the photoconductive drum 11 in a constant −750 V sequentially according to the rotation of the photoconductive drum 11. The laser exposure device 13 irradiates a laser light 13*a* at an irradiating position 13*b* on the charged photoconductive drum 11 according to the image information.

The paper P that is the recording medium is taken-out from a paper feeding cassette 20 by a paper feeding roller 21. The paper P is carried to the position of the transfer charger 16 of the image forming section 10 by a resist roller 22 synchronized with the formation of the toner image on the photoconductive drum 11. An unfixed toner image that is formed by the decoloring toner is formed on the paper P by the image forming section 10. The paper feeding cassette 20 can feed unused paper and reused paper simultaneously.

A fixing device 26 is provided on the upper side of the image forming section 10. The fixing device 26 heats, pressurizes, and fixes the paper P. The fixing device 26 has a fixing roller 27 that is a fixing rotation body and a pressing roller 28 that is a pressing rotation body that is press-contacted to the fixing roller 27. The fixing device 26 has an inlet guide 26*a* that guides the paper P to a nip between the fixing roller 27 and the pressing roller 28.

The fixing roller 27 is constituted by coating a PTFE (polytetrafluoroethylene) on the surface of a hollow circular cylinder made of iron. The fixing roller 27 has an IH coil (induction heating coil) 30 in the inside thereof. The fixing roller 27 is induction heated directly from the inside thereof. A thermistor 31 detects the temperature of the surface of the fixing roller 27. A current of the IH coil 30 is controlled by the output of the thermistor 31 and the temperature of the surface of the fixing roller 27 is controlled in a predetermined temperature.

The pressing roller 28 forms an elastic layer comprising a foaming silicon sponge rubber or the like on a metal shaft, and is formed by coating a PFA (copolymer of tetrafluoro-ethylene and perfluoro-alkylvinyl ether) tube on the surface. The hardness of the pressing roller 28 is about 55° in ASKER-C. The pressing roller 28 largely grips the nip about 6 mm by the elastic layer so that the low heat capacity is achieved for the fixing of the energy saving.

A paper-discharging roller 32 that discharges the fixed paper P in a predetermined direction is provided at a downstream of the fixing device 26 in the carrying direction of the paper P.

Figure 4:
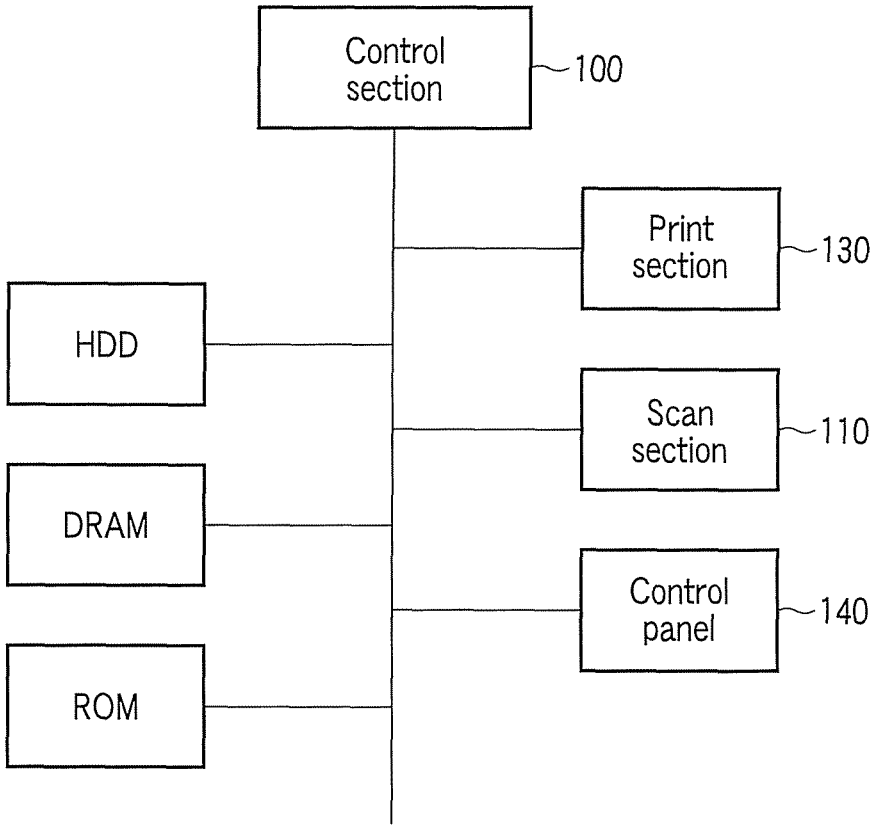
FIG. 4 is an exemplary block diagram illustrating a constitution of a control system of the image forming apparatus of the embodiment.

FIG. 4 is an exemplary block diagram illustrating the constitution of a control system of the image forming apparatus 1 of the embodiment.

The image forming apparatus 1 further includes a control section 100, a ROM, a DRAM and an internal memory unit (HDD), together with the above-described the print section 130, the scan section 110 and the control panel 140. Each of these sections is connected to each other through a system bus.

The control section 100 controls each of sections that are connected through the system bus. The ROM stores various types of control programs, which are required to operate the image forming apparatus 1. Within the ROM, each program is stored so as to control the image forming operation and the image erasing operation as described below. Execution of each of the programs is controlled by the control section 100. A DRAM is a buffer memory that temporarily stores data that is generated when each of the programs is executed.

Figure 5:
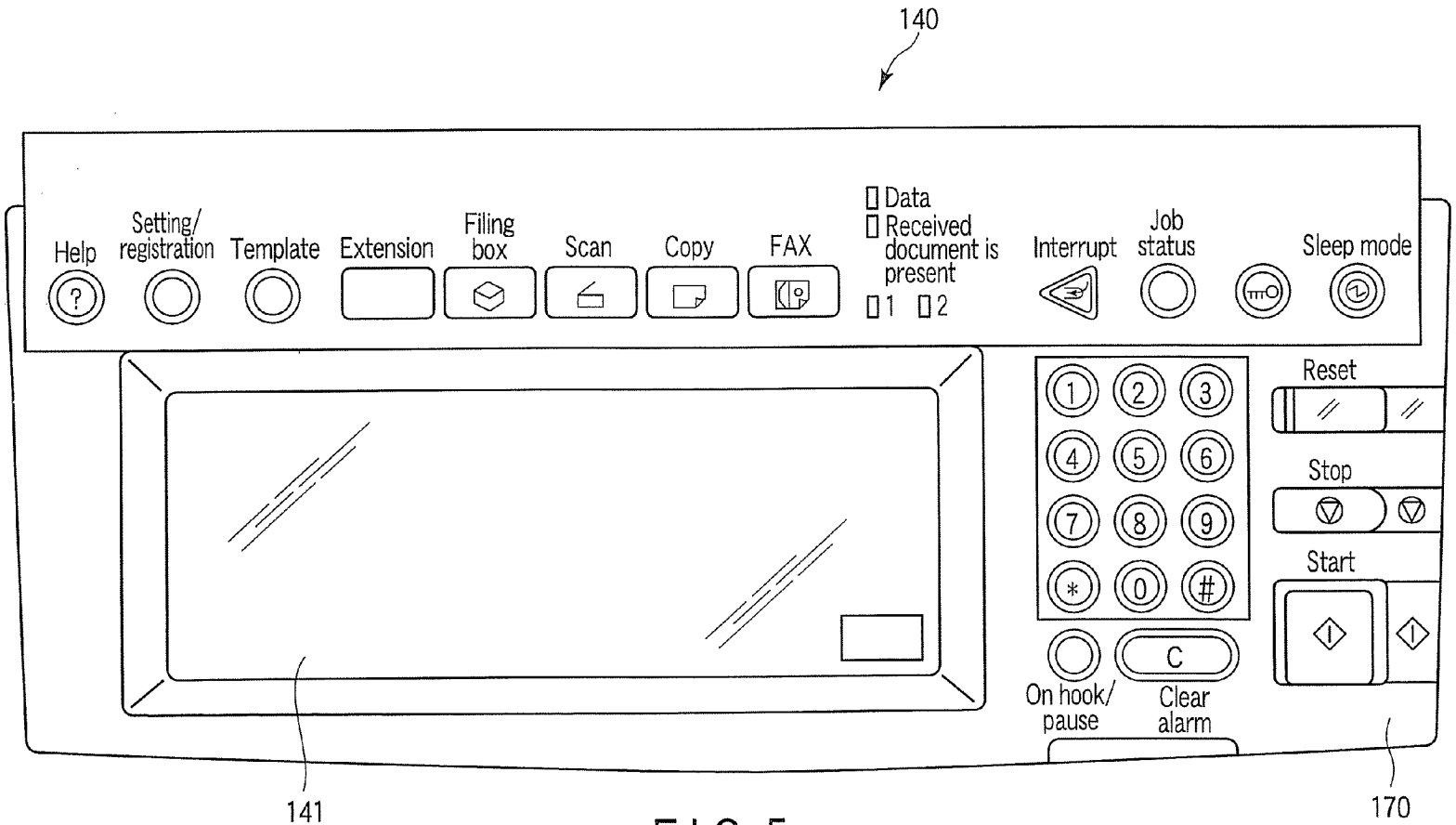
FIG. 5 is an exemplary exterior view illustrating a control panel that is provided in the image forming apparatus of the embodiment.

FIG. 5 is an exemplary exterior view of the control panel 140 that is provided in the image forming apparatus of the embodiment. The touch panel display 141 and an operation section 170 are provided at the control panel 140. The touch panel display 141 constitutes a touch panel and displays the state of the image forming apparatus 1, an order of operations, and each type of instruction with respect to the user. Each type of operation button, including a start button to operate the image forming apparatus 1, is provided in the operation section 170.

Next, an image forming process by the image forming apparatus 1 is described.

In the image forming section 10, when the image forming process is started, the photoconductive drum 11 that is rotated in the direction of the arrow s with a peripheral velocity of 215 mm/sec of a first paper carrying velocity is charged to a constant −750 V by the charging charger 12. In the photoconductive drum 11, the laser light is irradiated and an electrostatic latent image is formed according to the document information by the laser exposure device 13. Next, the electrostatic latent image is developed by the developing device 14 using the decoloring toner and the toner image comprised of the decoloring toner is formed on the photoconductive drum 11.

In the embodiment, as the decoloring toner, a capsule-type thermal decoloring toner that is made by a chemical method as described below, is used.

(1) A Binder Resin and a Wax Atomization Liquid.

A Pes resin is used as the binder resin. A resin atomization liquid is prepared using a high-pressure homogenizer and using the Pes resin, an anionic-emulsifier and a counteragent.

(2) Adjustment of the Wax Atomization Liquid.

The atomization liquid is obtained using a rice WAX in the same manner as the above-described resin.

(3) Adjustment of the Toner.

A leuco dye: CVL (crystalvioletlactone), a developing agent: 4-hydroxy benzoic acid benzene. A temperature control agent: a 4-benzyloxyphenylethyl laurate.

The above-described material is melted by heating and to be capsulated by known coacervation method. The capsulated color material, the toner binder resin dispersion liquid, the WAX dispersion liquid are condensed, fused, cleaned and dried, using sulfate $Al[Al_2(SO_4)_3]$ so that the toner is obtained. Proper additives are added to the toner. Hereinafter, the toner is referred to as capsule-type decoloring toner.

The capsule-type decoloring toner that is used in the embodiment is manufactured so that the amount of the color material that is capsulated is 10 wt % of the toner before external additives are added thereto.

The developing device 14 uses a two-component developer that is a mixture of the above-described capsule-type decoloring toner of which the volume average particle diameter is 5 to 12 μm and a magnetic carrier of which the volume average particle diameter is 30 to 80 μm. The real specific gravity of the capsule-type decoloring toner is in a range of about 0.9 to 1.2 g/cm$^3$. The decoloring toner image on the formed paper is heated 90° C. or more so that the conjuncture of a pigment within the capsule and a color former is cut and the color of the toner image is erased. A developing bias of about −550 V is applied to a developing roller 14*a* of the developing device 14 and the toner image is formed on the photoconductive drum 11 with an electrostatic latent image by a reversal developing.

Meanwhile, the paper P is supplied from the paper feeding cassette 20. The paper P is carried to the position of the transfer charger 16 and transfers the toner image on the photoconductive drum 11 synchronized with the formation of the toner image on the photoconductive drum 11 by the resist roller 22.

After the paper P in which the toner image is transferred is peeled from the photoconductive drum 11, the paper P is carried to the fixing device 26. The temperature of the surface of the fixing roller is controlled to be 160° C. The paper P is inserted between the fixing roller 27 and the pressing roller 28, and the toner image is heated, pressurized and fixed. Since the fixing roller 27 and the pressing roller 28 have reverse crown shapes, both end portions of the paper P are more reliably pulled toward the front than the center portion thereof when the paper P is inserted and passed through the nip between the fixing roller 27 and the pressing roller 28. Since the pressing roller 28 has reverse crown shape, the paper P is heated, pressurized and fixed while pulled in the end direction from the center so that wrinkles are prevented from occurring. After the toner image is fixed by the capsule-type decoloring toner at the fixing device 26, the paper P is discharged in a predetermined direction by the paper-discharging roller 32.

After the transfer is finished, the residual toner of the photoconductive drum 11 is cleaned by the cleaner 18, a residual charge is removed by the discharge LED 19 and the image forming process is finished.

At the peripheral velocity of 215 mm/sec of the first paper carrying velocity, the temperature of the capsulated color material is not over 90° C. and the decoloring does not occur when the image is formed. However, the image density of the embodiment after the image is fixed by the capsule-type decolorizing toner is 0.3 that is barely acceptable degree of the image density in the respect of visibility. Thus, it is known that the amount of color material of the capsule-type decolorizing toner is preferably 10 wt % or more so as to secure the visibility of the image. The visibility of the image is evaluated by using a measurement device (For example, X-rite).

Next, description will be given regarding the image-erasing process of the related art.

Until now, erasing of capsule-type toner image has been performed for example, by using "erasing device for e-blue (registered trade Mark): TMD-HE01" that is an exclusive erasing device made by TOSHIBA CORP. The paper P is heated for about two hours at 120 to 150° C. and the color of the toner image is removed. Then, auto-cooling is performed for about one hour. When the paper P from which the toner image is removed is reused, the paper Ps that are slightly attached to each other due to the heating are lightly treated so as to be peeled and the paper Ps are supplied to the paper feeding cassette device 20. The reused paper P that is supplied to the paper feeding cassette device 20 is served to the image formation according to the image forming process. However, since the erasing of the color by the erasing device is a time consuming process, it does not support a case where the paper is reused quickly.

In the embodiment, the image is erased using the image forming apparatus 1 as the instant erasing property of the capsule-type erasing color toner being used.

In the paper P in which the image is formed by the capsule-type decoloring toner, the color of the toner image is erased and reused after usage is finished, so that the paper P is set to the paper feeding cassette device 20. The user performs the operation for the erasing of the image. The paper P in which the image is formed may also be set to the specific paper feeding cassette device 20 or a manual device.

Figure 6:
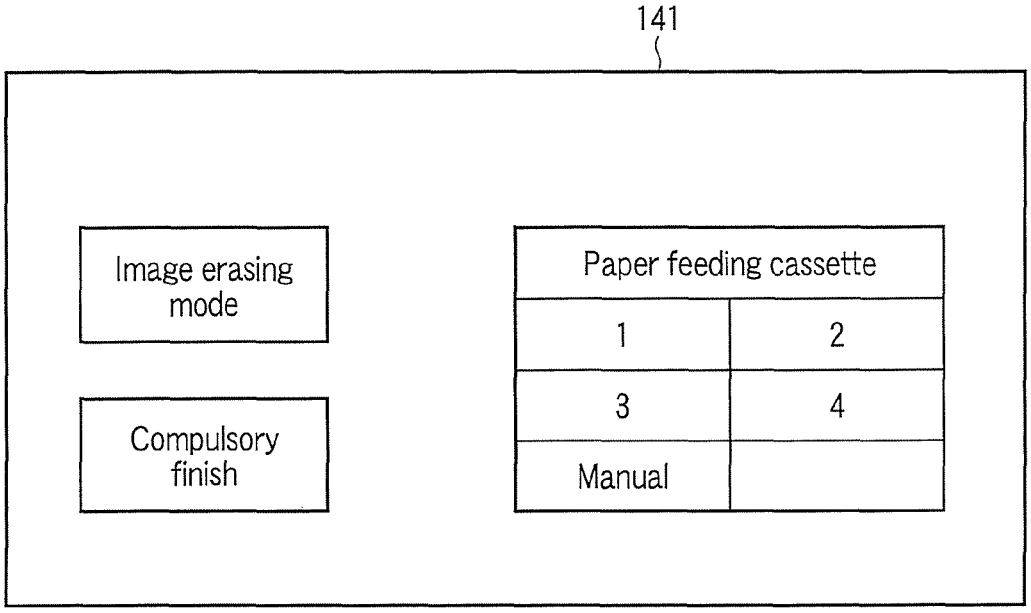
FIG. 6 is a view illustrating an exemplary image erasing operation screen that is displayed on the control panel of the embodiment.

FIG. 6 is a drawing illustrating an exemplary image erasing operation screen that is displayed on the control panel 140 of the embodiment.

The user presses the image erasing mode button from the image erasing operation screen. The user indicates a cassette as the cassette of the paper-feeding source in which the paper P for reuse from the manual supply tray and the cassettes 1 to 4 is stored. When the start button that is provided at the operation section 170 of the control panel 140 is pressed, the erasing operation is started. The image erasing operation screen is not limited to the constitution and may be constituted incorporating the operation buttons for erasing the image at the operation screen of the related art. The paper P for reuse may be taken out from the specific cassette without designating the cassette.

In the image erasing mode, the photoconductive drum 11 is driven in the direction of arrow s with a peripheral velocity of 21 mm/sec as a "second paper carrying velocity". In the image erasing mode, an electrostatic latent image corresponding to the image information by the laser exposure device 13 is not formed on the photoconductive drum 11. In other words, the paper P is carried to the fixing device 26 through a route that is the same as above-described image forming.

In the image erasing mode, even the fixing device 26 carries the paper with the "second paper carrying velocity" of 21 mm/sec while the paper is heated, pressurized, and fixed. At this time, the temperature of the surface of the fixing roller 27 is 160° C., the same as when the image is formed. The paper is heated with a carrying velocity that is slower than that of the image forming process so that the toner image on the paper is heated to 90° C. or more and the color can be erased by the instant color clearing property of the capsule-type color clear toner.

The above-described operation is continued until the paper is no longer present within the paper feeding cassette device 20. Thus, when the absence of the paper within the paper feeding cassette device 20 is detected and the last paper that is discharged from the device is detected, the mode is returned to a predetermined modes (a normal printing mode, a ready mode, an energy saving mode or the like) automatically other than the image erasing mode. The constitution is such that the image erasing mode is automatically finished and the mode is returned to a predetermined mode (a normal printing mode, a ready mode, an energy saving mode or the like) other than the image erasing mode so that the color of toner image of a plurality of papers for which the usage is finished can be removed using for example, a time period in which there is almost no normal printing, such as night time or the like.

A compulsory finish button that compulsorily finishes the image erasing mode is provided at the above-described image erasing screen. When the button is operated, the image erasing mode is finished and the mode is returned to the predetermined mode (the normal printing mode, the ready mode, the energy saving mode or the like).

In the above-described embodiment, the fixing roller 27 is heated, however the pressing roller 28 may be also heated simultaneously. The paper P is set within the paper feeding cassette device 20 so that the surface on which the erasing toner is printed is directly contacted to the fixing roller 27, however it is not limited to the embodiment, and the paper P may be set within the paper feeding cassette device 20 so that a rear surface of the surface on which the erasing toner is printed is directly contacted to the fixing roller 27. The presence or absence of heating of the fixing roller 27 and the pressing roller 28, the heating condition of the heating temperature or the like, the condition of the "second paper carrying velocity", the thickness and the kind of paper or the like are properly selected so that the image erasing mode can be performed without depending on a method of positioning the paper within the paper feeding cassette device 20.

Second Embodiment

In the second embodiment, the paper is not carried through the photoconductive drum 11 and that is different from the first embodiment. Accordingly, the portions that are identical to the first embodiment are given identical reference numbers thereof, and thus not specifically described here.

A decoloring operation of the second embodiment will be described with reference to FIG. 3.

When the toner image that is formed by the capsule-type decoloring toner is erased, the paper P is set to a paper feeding section that is not shown. When the start of the image erasing mode is input, the paper P is supplied to a paper path P2 without passing through photoconductive drum 11. The paper P is moved on the paper path P2, guided to the fixing device 26 by the switching of a gate 41. The carrying velocity is the "second paper carrying velocity" of 21 mm/sec that is different from the "first paper carrying velocity" of 215 mm/sec when the image is formed, and the fixing device 26 also heats, pressurizes, and fixes the paper while carrying the paper in the "second paper carrying velocity" of 21 mm/sec.

In the fixing device 26, the toner image on the paper P is heated. The conjuncture of the pigment and the color former is cut and the image is changed from the color forming state to the decoloring state by heat. The color of the capsule-type toner image is erased and then the image erasing is completed.

The paper P in which the image is erased is discharged in a predetermined direction by the paper-discharging roller 32 that is arranged at the downstream of the fixing device 26 in the carrying direction of the paper P. If the paper is set to the paper feeding cassette device 20 again, the paper can be reused as the image forming paper.

The operation condition of the fixing device 26 is the same as the operation condition when the image is erased that is described in the first embodiment. Also, similar to the first embodiment, at the time that the absence of the paper within the paper feeding section that is not shown is detected and the last paper that is discharged from the device is detected, the sequence is employed in which the mode is automatically returned to the normal printing mode.

In the second embodiment, if the image is erased, the photoconductive drum 11 can be stopped so that there is an advantage in that consumable articles, such as a photosensitive body, are not wasted to no purpose.

Third Embodiment

In the third embodiment, the image forming apparatus includes an exclusive fixing device for the image erasing, and that is different from the first embodiment. Accordingly, the portions that are identical to the first embodiment are given identical reference numbers thereof, and thus not specifically described here.

Figure 7:
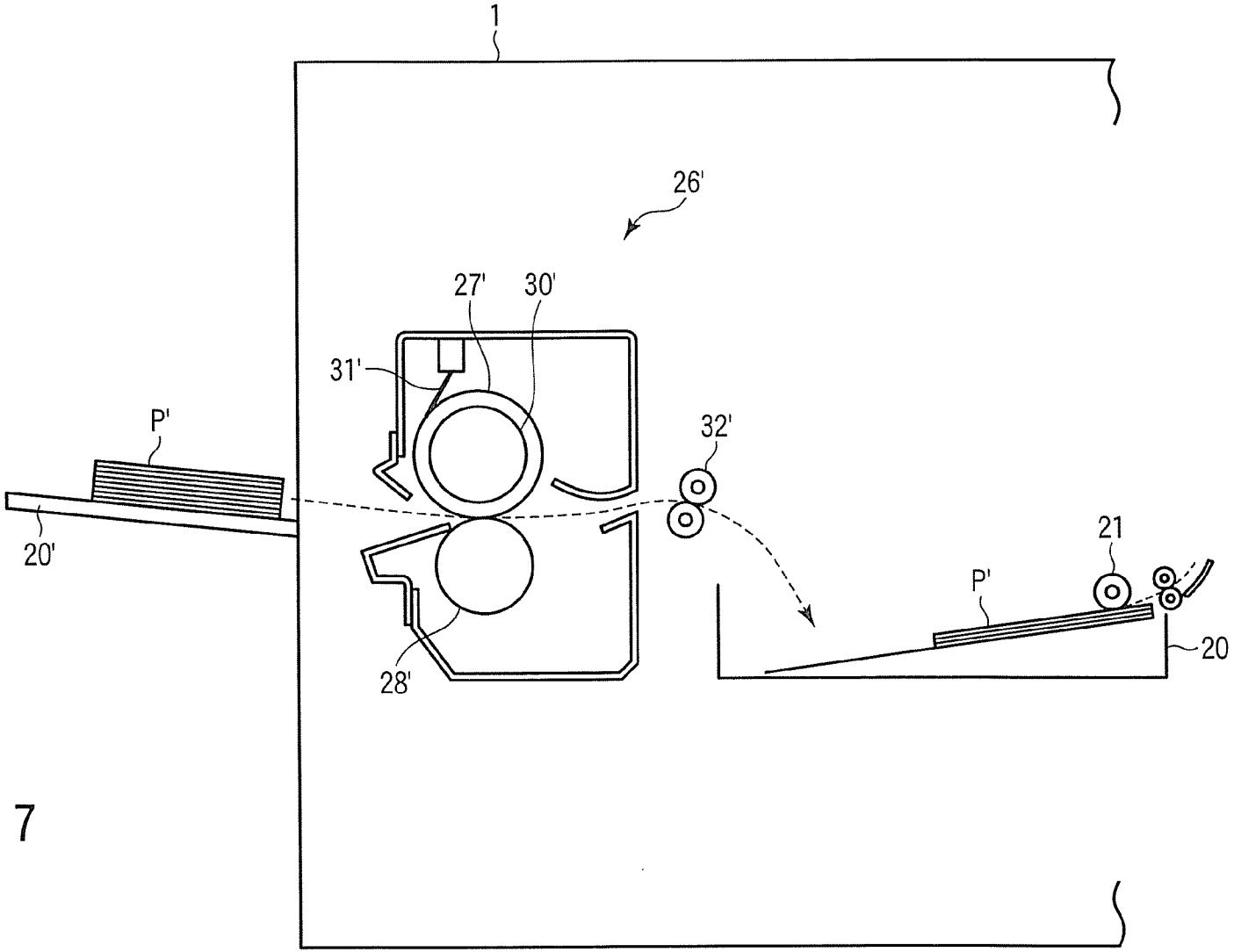
FIG. 7 is an exemplary view to explain the image erasing operation of a third embodiment.

FIG. 7 is an exemplary drawing for explaining the image erasing operation of the third embodiment.

Different from the first embodiment, a fixing device 26' that is exclusive for image erasing is provided separated from the fixing device 26 within the image forming apparatus. When the image is erased, a paper P' on which the toner image is formed and is set to a paper feeding section 20' is supplied to the fixing device 26'. The fixing device 26' heats and pressurizes while carrying the paper in "the second paper carrying velocity" of 21 mm/sec. The toner image on the paper P' is heated. The conjuncture of the pigment and the color former is cut and the color of the capsule-type toner image is erased, and the image erasing is completed by heat.

The paper P' in which the image is erased is discharged by the paper-discharging roller 32' that is arranged at the downstream of the fixing device 26' in the carrying direction. The paper P' is carried and set to the paper feeding cassette device 20, the paper P' can be reused as the image forming paper.

Fourth Embodiment

In the fourth embodiment, the amount of the color material of the capsule-type erasing toner is different from the first embodiment. Accordingly, the portions that are identical to the first embodiment are given identical reference numbers thereof, and thus not specifically described.

In the fourth embodiment, capsule-type erasing toner is manufactured so that the amount of the color material that is capsulated is 30 wt % of the toner before external additives are added. The capsule-type erasing toners in which the amounts of color materials are different are used and then the test that is performed in the same manner as the contents of the first embodiment is performed.

The obtained fixed image is high in the image density and excellent in the visibility thereof. However, in the image after the color of the toner image is erased by performing the image erasing operation that is described in the first embodiment, the color of the capsule is not completely erased and remained. The image density after the color is erased is 0.2 and as background noise, is limited to the permissible range to reuse the paper. Accordingly, the amount of the color material of the capsule-type erasing toner is preferably 30 wt % or less to effectively erase the image.

According to the first embodiment, the amount of the color material of the capsule-type decoloring toner is preferably 10 wt % or more so as to secure the visibility of the image. According to the fourth embodiment, the amount of the color material of the capsule-type decoloring toner is preferably 30 wt % or less for the decoloring to effectively function. Accordingly, the preferred amount of the color material of the capsule-type decoloring toner is considered of 10 wt % to 30 wt %.

Fifth Embodiment

In the fifth embodiment, even when the color erasing operation is performed, the paper is carried at a carrying velocity, the same as that of the image forming, and that is different from the first embodiment. Accordingly, the portions that are identical to the first embodiment are given identical reference numbers thereof, thus not specifically described in here.

In the fifth embodiment, capsule-type erasing toner is manufactured so that the amount of the color material that is capsulated is 30 wt % of the toner before external additives are added. When the toner image that is formed by the capsule-type decoloring toner is erased, the paper P is set to the paper feeding cassette device 20. When the start of the image erasing mode is input, the photoconductive drum 11 of image forming section 10 is driven in the direction of the arrow s with a peripheral velocity of 215 mm/sec of "the first paper carrying velocity", the same as when the image is formed.

In the image erasing mode, the electrostatic latent image according to the image information by the laser exposure device 13 is not formed in the photoconductive drum 11. The paper P is carried to the fixing device 26 with the peripheral velocity of 215 mm/sec of the "first paper carrying velocity" through the process the same as when the image is formed. In the image erasing mode, the fixing device 26 heats, pressurizes, and fixes the paper with 190° C. of "the second fixing temperature" that is higher than the fixing temperature of the first embodiment while carrying the paper. Under these conditions, the toner image on the paper is heated 90° C. or more and the paper P can be color erased by the instant decoloring property of the capsule-type decoloring toner.

The above-described operation is continued until there are no further papers within the paper feeding cassette device 20. Thus, when the absence of the paper within the paper feeding cassette device 20 is detected and the last paper that is discharged from the device is detected, the mode is automatically returned to the normal printing mode. The constitution is such that the image erasing mode is automatically finished and the mode is returned to a predetermined mode other than the image erasing mode so that the color of toner image of a plurality of papers for which the usage is finished can be removed using, for example, a time period in which there is almost no normal printing, such as night time or the like.

However, if the gap between carried papers in image erasing mode is the same, approximately 80 mm, as when the image is formed, a phenomenon occurs in which the discharged papers are attached to each other with the toner. The toner resin is attached to the rear surface of the paper that is relatively soft and heavy since the temperature of the paper is high just after the paper is discharged. As a result of the test performed in which the gaps of the papers were changed to various values, if the gap of the papers is about 400 mm when the mode is the image erasing mode, the discharged papers are not attached even though 100 sheets of paper are continuously erased. This is because that the next paper is discharged in a state where the discharged papers are cooled.

Thus, the time gap in which the paper is supplied to the fixing device 26 is changed to about 2 seconds (≅400/215 seconds) or more so that the phenomenon in which the papers are attached to each other can be avoided.

As described above in the embodiments, when in the image erasing mode, the paper carrying velocity is slow or the fixing temperature is high compared to when the image is formed. When in the image erasing mode, the driving is performed at the predetermined second paper carrying velocity or the operation conditions of the second fixing temperature. However, the proper values of these driving conditions, when in the image erasing mode, are considered to be different according to the medium that is used (kind and thickness), the physical properties of the toner that is used, or the like.

For example, the property of the medium that is used (kinds and thickness) and the physical properties (performance of the decoloring) of the toner that is used are detected or obtained by the input of the setting by the user, so that the driving condition may be switched when the mode is the image erasing mode. At this time, driving methods as described below, may be properly assembled according to the driving condition.

(1) The second carrying velocity in which the paper carrying velocity is slow compared to when the image is formed is set to the carrying control system when in the image erasing mode.

(2) The second fixing temperature in which the fixing temperature is high compared to when the image is formed is set to the fixing device when in the image erasing mode.

(3) The second carrying velocity in which the paper carrying velocity is slow compared to when the image is formed is set to the carrying control system, and the second fixing temperature in which the fixing temperature is high is set to the fixing device when in the image erasing mode.

Each of the functions that are described in the above-described embodiments may be constituted using hardware, and may be realized using software wherein a program in which each of functions is written is read on the computer. Each of the functions may be constituted through selection of any one of the appropriate software and the hardware.

Furthermore, each of the functions can be realized such that the program that is accommodated in the recording medium that is not shown is read in the computer. For the recording medium of the embodiments, the recording type may be of any type if the recording medium can record the program and can be read in the computer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming section configured to form an image on a medium, using a thermally decolorable recording material containing a leuco dye and a developable material;

a heating section configured to heat the medium while carrying the medium;

a supply section configured to supply the medium with the image formed thereon using the thermally decolorable recording material; and a control section configured to set a temperature of the heating section higher in an image decoloring mode than in modes other than the image decoloring mode to decolor the image on the medium by heating the image with the heating section, and also configured to return the image decoloring mode to a predetermined mode other than the image decoloring mode when the image formed on the medium, using the thermally decolorable recording material, has been decolored, the image on the medium being not decolored in the modes other than the image decoloring mode.

2. The apparatus according to claim 1, wherein the thermally decolorable recording material that is used in the image forming apparatus is a thermal decolorable toner including 10 to 30 wt % of the composition rate of a capsulated color material which includes at least the leuco dye and a color developing agent.

3. The apparatus according to claim 1, wherein the image forming apparatus is an electro-photographic image forming apparatus, and the heating section heats a medium at a first medium carrying velocity when fixing an image formed on the medium, and heats the medium at a second medium carrying velocity that is slower than the first medium carrying velocity when decoloring the image on the medium.

4. The apparatus according to claim 3, wherein a gap between pieces of the medium when heating the medium at the second medium carrying velocity is longer than a gap between pieces of the medium when the medium is carried at the first medium carrying velocity at the time of image fixing.

5. The apparatus according to claim 3, wherein an interval between pieces of the medium when heating the medium in the second medium carrying velocity is two seconds or more.

6. The apparatus according to claim 1, wherein the image forming apparatus is an electro-photographic image forming apparatus, and the heating section heats a medium at a first medium carrying velocity when fixing an image formed on the medium, and another heating section that is provided in the image forming apparatus heats the medium at a second medium carrying velocity that is slower than the first medium carrying velocity when decoloring the image on the medium.

7. The apparatus according to claim 1, wherein the image forming apparatus is an electro-photographic image forming apparatus, and the heating section heats a medium at a first heating temperature when fixing an image formed on the medium, and heats the medium at a second heating temperature that is higher than the first heating temperature when decoloring the image on the medium.

8. The apparatus according to claim 7, wherein a gap between pieces of the medium when heating the medium at the second heating temperature is longer than a gap between pieces of the medium when heating the medium at the first heating temperature at the time of fixing the image.

9. The apparatus according to claim 7, wherein an interval between pieces of the medium when heating the medium at the second heating temperature is two seconds or more.

10. The apparatus according to claim 1, wherein the image forming apparatus is an electro-photographic image forming apparatus, and the heating section heats a medium at a first heating temperature when fixing an image formed on the medium, and another heating section that is provided in the image forming apparatus heats the medium at a second heating temperature that is higher than the first heating temperature when decoloring the image on the medium.

11. An image forming method for use in an image forming apparatus including an image forming section configured to form an image on a medium, using a thermally decolorable recording material containing a leuco dye and a developable material, and a heating section configured to heat the medium while carrying the medium, comprising:

in an image decoloring mode, supplying the medium with the image formed thereon using the thermally decolorable recording material;

setting a temperature of the heating section higher than in modes other than the image decoloring mode to decolor the image on the medium by heating the image with the heating section; and returning the image decoloring mode to a predetermined mode other than the image decoloring mode when the image formed on the medium, using the thermally decolorable recording material, has been decolored, the image on the medium being not decolored in the modes other than the image decoloring mode.

12. The method according to claim 11, wherein the thermally decolorable recording material that is used in the image forming apparatus is a thermal decolorable toner including 10 to 30 wt % of the composition rate of a capsulated color material that includes at least the leuco dye and a color developing agent.

13. The method according to claim 11, wherein the image forming apparatus is an electro-photographic image forming apparatus, and the heating section heats a medium at a first medium carrying velocity when fixing an image formed on the medium, and heats the medium at a second medium carrying velocity that is slower than the first medium carrying velocity when decoloring the image on the medium.

14. The method according to claim 13, wherein a gap between pieces of the medium when heating the medium at the second medium carrying velocity is longer than a gap between pieces of the medium when the medium is carried at the first medium carrying velocity at the time of image fixing.

15. The method according to claim 13, wherein an interval between pieces of the medium when heating the medium in the second medium carrying velocity is two seconds or more.

16. The method according to claim 11, wherein the image forming apparatus is an electro-photographic image forming apparatus, and the heating section heats a medium at a first medium carrying velocity when fixing an image formed on the medium, and another heating section that is provided in the image forming apparatus heats the medium at a second medium carrying velocity that is slower than the first medium carrying velocity when decoloring the image on the medium.

17. The method according to claim 11, wherein the image forming apparatus is an electro-photographic image forming apparatus, and the heating section heats a medium at a first heating temperature when fixing an image formed on the medium, and heats the medium at a second heating temperature that is higher than the first heating temperature when decoloring the image on the medium.

18. The method according to claim 17, wherein a gap between pieces of the medium when heating the medium at the second heating temperature is longer than a gap between pieces of the medium when heating the medium at the first heating temperature at the time of fixing the image.

19. The method according to claim 17, wherein an interval between pieces of the medium when heating the medium at the second heating temperature is two seconds or more.

20. The method according to claim 11, wherein the image forming apparatus is an electro-photographic image forming apparatus, and the heating section heats a medium at a first heating temperature when fixing an image formed on the medium, and another heating section that is provided in the image forming apparatus heats the medium at a second heating temperature that is higher than the first heating temperature when decoloring the image on the medium.

* * * * *